US011491081B2

(12) United States Patent
Akaikine et al.

(10) Patent No.: US 11,491,081 B2
(45) Date of Patent: Nov. 8, 2022

(54) SYSTEMS AND METHODS FOR TREATING NAUSEA AND VOMITING

(71) Applicant: Sense Relief Inc., Campbell, CA (US)

(72) Inventors: Andrei Akaikine, Mountain View, CA (US); Sidhartha Ranjit Sinha, San Francisco, CA (US); Moshe Zilversmit, Campbell, CA (US)

(73) Assignee: Sense Relief Inc., Campbell, CA (US)

( * ) Notice: Subject to any disclaimer, the term of this patent is extended or adjusted under 35 U.S.C. 154(b) by 153 days.

(21) Appl. No.: 16/800,346

(22) Filed: Feb. 25, 2020

(65) Prior Publication Data

US 2020/0268602 A1 Aug. 27, 2020

Related U.S. Application Data

(60) Provisional application No. 62/810,259, filed on Feb. 25, 2019.

(51) Int. Cl.
*A61H 39/00* (2006.01)

(52) U.S. Cl.
CPC ..... *A61H 39/007* (2013.01); *A61H 2201/165* (2013.01); *A61H 2201/5007* (2013.01); *A61H 2201/5097* (2013.01); *A61H 2205/06* (2013.01); *A61H 2230/065* (2013.01); *A61H 2230/305* (2013.01); *A61H 2230/425* (2013.01); *A61H 2230/505* (2013.01); *A61H 2230/625* (2013.01)

(58) Field of Classification Search
CPC ... A61H 39/007; A61H 1/00; A71H 2201/165
See application file for complete search history.

(56) References Cited

U.S. PATENT DOCUMENTS 4,574,787 A 3/1986 Jacobs
4,981,146 A * 1/1991 Bertolucci ..... A61H 39/002 607/72

(Continued)

OTHER PUBLICATIONS

Sinha, Sidhartha R., et al., "Using Apple Watch to Improve Management of Nausea and Vomiting", Center for Digital Health Apple Watch Seed Research Grant.

*Primary Examiner* — Samchuan C Yao
*Assistant Examiner* — Nathan M Le
(74) *Attorney, Agent, or Firm* — Fortern IP LLP; Matthew Lincicum

(57) ABSTRACT

A wearable stimulator device can be used to treat nausea and vomiting resulting from pregnancy, gastroparesis, virtual reality use, motion sickness, chemotherapy, and post-surgical nausea and vomiting, or other conditions by stimulating the P6 point of a user's forearm. A method of treating nausea includes monitoring one or more physiological parameters of a user via a wearable device, for example a smartwatch. Based on the one or more physiological parameters, the P6 point of the user's forearm can be stimulated for a predetermined time, for example via vibrational stimulation effected via a smartwatch or other wearable device. Data regarding the user's physiological parameters, stimulation sessions, and user-provided input regarding treatment efficacy and user symptoms can be collected and analyzed at scale to develop improved treatment regimes, for example modifying stimulation waveforms and/or timing, and identifying physiological parameters useful for predicting the onset of nausea.

18 Claims, 3 Drawing Sheets

(56) References Cited

U.S. PATENT DOCUMENTS

| | | | | |
|---|---|---|---|---|
| 5,078,728 | A | 1/1992 | Giarratano | |
| 5,774,424 | A | 6/1998 | Yoo | |
| 6,178,352 | B1 | 1/2001 | Grey et al. | |
| 6,228,103 | B1 * | 5/2001 | Grey | A61H 39/04 601/107 |
| 6,382,215 | B1 | 5/2002 | Morrish | |
| 6,567,695 | B1 * | 5/2003 | Gruzdowich | A61H 39/002 128/907 |
| 6,582,449 | B2 | 6/2003 | Grey et al. | |
| 7,089,061 | B2 | 8/2006 | Grey | |
| 2001/0023359 | A1 | 9/2001 | Grey et al. | |
| 2002/0156501 | A1 | 10/2002 | Gruzdowich et al. | |
| 2004/0044362 | A1 | 3/2004 | Klassen | |
| 2004/0098037 | A1 | 5/2004 | Grey et al. | |
| 2004/0167588 | A1 | 8/2004 | Bertolucci | |
| 2004/0172096 | A1 | 9/2004 | Grey et al. | |
| 2007/0293777 | A1 * | 12/2007 | Shan | A61B 5/7275 600/512 |
| 2008/0033504 | A1 | 2/2008 | Bertolucci | |
| 2013/0138143 | A1 | 5/2013 | Chechelnitsky | |
| 2016/0346501 | A1 * | 12/2016 | Hooper | A61B 5/4836 |
| 2018/0036534 | A1 * | 2/2018 | Shin | A61N 1/36031 |
| 2019/0001131 | A1 * | 1/2019 | Ziv | A61B 5/332 |
| 2020/0121544 | A1 * | 4/2020 | George | A61H 9/0071 |
| 2020/0222279 | A1 * | 7/2020 | Spring | A61H 39/002 |

* cited by examiner

SYSTEMS AND METHODS FOR TREATING NAUSEA AND VOMITING

CROSS-REFERENCE TO RELATED APPLICATION

The present application claims the benefit of priority to U.S. Patent Application No. 62/810,259, filed Feb. 25, 2019, which is incorporated by reference herein in its entirety.

TECHNICAL FIELD

The present technology relates to devices for treatment of pregnancy related nausea, and vomiting (morning sickness) and associated systems and methods of use. In particular, the present technology is directed to devices for treating nausea and vomiting and other conditions using wearable devices.

BACKGROUND

Nausea and vomiting may be brought on by a number of factors, for example, pregnancy, gastroparesis, virtual reality use, motion sickness, chemotherapy treatment, post-surgical recovery, or other conditions. Over the years, various interventions have been applied to relieve the symptoms of nausea and vomiting with variable success. Examples include acupressure, mechanical stimulation, electrical stimulation, or acupuncture delivered at the P6 point, which is located on the ventral side of the wrist, overlying the median nerve. Acupressure or acustimulation has been shown reduce nausea after surgery or chemotherapy and may also offer relief in gastroparesis. Two examples of disorders where nausea and vomiting are very common symptoms are gastroparesis and pregnancy-associated nausea and vomiting ("morning sickness" or hyperemesis gravidarum) Gastroparesis, objectively delayed gastric emptying, affects up to 4% of the US population and can lead to severe disability. The cause of gastroparesis is unknown in about half of patients; diabetes is the most recognized disease causing gastroparesis. Nausea and vomiting of pregnancy have been shown to affect the majority of pregnant women. Other examples of treatments for nausea and vomiting include pharmaceutical interventions (e.g., Zofran), dietary changes, and herbal supplements. Some of these treatments are associated with undesirable side effects and may be particularly undesirable for pregnant women. Other approaches may lose efficacy over time (e.g., constant mechanical stimulation at the P6 point tends to lose efficacy over time due to desensitization or tachyphylaxis). Accordingly, there remains a need for improved systems and methods for treating morning sickness, nausea, and vomiting.

SUMMARY

The present technology is directed to treating morning sickness, nausea, and vomiting. The subject technology is illustrated, for example, according to various aspects described below, including with reference to FIGS. 1A-3. Various examples of aspects of the subject technology are described as numbered clauses (1, 2, 3, etc.) for convenience. These Clauses may be combined in any order. These are provided as examples and do not limit the subject technology.

Clause 1. A method of treating nausea, the method comprising:

monitoring one or more physiological parameters of a user via a wearable device;

based at least in part on the one or more physiological parameters, stimulating a region of the user's wrist about a P6 point for a predetermined time; and after the predetermined time, ceasing stimulating the region the user's wrist.

Clause 2. The method of Clause 1, wherein the wearable device is configured to be worn over a user's wrist.

Clause 3. The method of any of the preceding Clauses, wherein stimulating the region comprises delivering energy to the region via the wearable device.

Clause 4. The method of any of the preceding Clauses, wherein stimulating the region comprises mechanically stimulating the region.

Clause 5. The method of any of the preceding Clauses, wherein stimulating the region comprises applying vibrational energy to the region.

Clause 6. The method of any of the preceding Clauses, wherein stimulating the region comprises applying acoustic energy to the region.

Clause 7. The method of any of the preceding Clauses, wherein stimulating the region comprises applying electrical energy to the region.

Clause 8. The method of any of the preceding Clauses, wherein stimulating the region comprises applying acupuncture and/or heat to the region.

Clause 9. The method of any of the preceding Clauses, further comprising, based on the one or more physiological parameters, providing an indication, via the wearable device, to the user to modify the user's behavior.

Clause 10. The method of Clause 9, wherein modification of the user's behavior comprises one or more of: changing body position, changing movement, changing breathing, changing food or fluid intake, changing location, turning on or turning off lights, contacting a specified individual, listening to a specified sound, or viewing a specified visual output.

Clause 11. The method of any of the preceding Clauses, wherein stimulating the region comprises stimulating the region in accordance with a waveform characterized by a frequency, intensity, and duration.

Clause 12. The method of Clause 11, wherein one or more of frequency, intensity, and duration are dynamically modified based on the one or more user parameters Clause 13. The method of any of the preceding Clauses, further comprising transmitting, via the wearable device, information regarding the treatment to one or more remote computing devices.

Clause 14. The method of any of the preceding Clauses, wherein monitoring one or more physiological parameters comprises sensing the user's heart rate.

Clause 15. The method of any of the preceding Clauses, wherein monitoring one or more physiological parameters comprises sensing the user's blood pressure.

Clause 16. The method of any of the preceding Clauses, wherein monitoring one or more physiological parameters comprises sensing the user's respiratory rate.

Clause 17. The method of any of the preceding Clauses, wherein monitoring one or more physiological parameters comprises sensing the user's bodily position.

Clause 18. The method of any of the preceding Clauses, wherein monitoring one or more physiological parameters comprises sensing the user's bodily movement.

Clause 19. The method of any of the preceding Clauses, wherein monitoring one or more physiological parameters comprises sensing the user's body temperature.

Clause 20. The method of any of the preceding Clauses, wherein monitoring one or more physiological parameters comprises sensing the user's geolocation.

Clause 21. The method of any of the preceding Clauses, wherein monitoring one or more physiological parameters comprises sensing the user's altitude.

Clause 22. The method of any of the preceding Clauses, wherein monitoring one or more physiological parameters comprises sensing chemical or electrolyte levels.

Clause 23. The method of any of the preceding Clauses, wherein monitoring one or more physiological parameters comprises receiving input from the user regarding one or more of: user symptoms, user food intake, user fluid intake, or user medication intake.

Clause 24. A method of treating nausea or a gastric motility disorder, the method comprising:

monitoring one or more physiological parameters of a user via a wearable device;

based at least in part on the one or more physiological parameters, stimulating the median nerve;

after the predetermined time, ceasing stimulating the median nerve.

Clause 25. A method of treating nausea, the method comprising:

receiving, at one or more computing devices, one or more physiological parameters associated with a user of a wearable device;

based at least in part on the one or more physiological parameters, identifying a likelihood of nausea;

in response to identifying a likelihood of nausea, providing instructions to the wearable device to initiate stimulation of a nerve of the user.

Clause 26. The method of any of the preceding Clauses, wherein the wearable device is configured to be worn over a user's wrist at a specified location.

Clause 27. The method of any of the preceding Clauses, wherein stimulating the nerve comprises delivering energy to the nerve via the wearable device.

Clause 28. The method of any of the preceding Clauses, wherein stimulating the nerve comprises mechanically stimulating the nerve.

Clause 29. The method of any of the preceding Clauses, wherein stimulating the nerve comprises applying vibrational energy to the nerve.

Clause 30. The method of any of the preceding Clauses, wherein stimulating the nerve comprises applying acoustic energy to the nerve.

Clause 31. The method of any of the preceding Clauses, wherein stimulating the nerve comprises applying electrical energy to the nerve.

Clause 32. The method of any of the preceding Clauses, wherein stimulating the nerve comprises applying acupuncture and/or heat to the nerve.

Clause 33. The method of any of the preceding Clauses, further comprising, based on the one or more physiological parameters, providing an indication, via the wearable device, to the user to modify the user's behavior.

Clause 34. The method of Clause 33, wherein modification of the user's behavior comprises one or more of: changing body position, changing movement, changing breathing, changing food or fluid intake, changing location, turning on or turning off lights, contacting a specified individual, listening to a specified sound, or viewing a specified visual output.

Clause 35. The method of any of the preceding Clauses, wherein stimulating the nerve comprises stimulating the nerve in accordance with a waveform characterized by a frequency, intensity, and duration.

Clause 36. The method of Clause 35, wherein one or more of frequency, intensity, and duration are dynamically modified based on the one or more user parameters Clause 37. The method of any of the preceding Clauses, wherein the one or more physiological parameters comprises the user's heart rate.

Clause 38. The method of any of the preceding Clauses, wherein one or more physiological parameters comprises the user's blood pressure.

Clause 39. The method of any of the preceding Clauses, wherein one or more physiological parameters comprises the user's respiratory rate.

Clause 40. The method of any of the preceding Clauses, wherein one or more physiological parameters comprises the user's bodily position.

Clause 41. The method of any of the preceding Clauses, wherein one or more physiological parameters comprises the user's bodily movement.

Clause 42. The method of any of the preceding Clauses, wherein one or more physiological parameters comprises the user's body temperature.

Clause 43. The method of any of the preceding Clauses, wherein one or more physiological parameters comprises the user's geolocation.

Clause 44. The method of any of the preceding Clauses, wherein one or more physiological parameters comprises the user's altitude.

Clause 45. The method of any of the preceding Clauses, wherein one or more physiological parameters comprises input from the user regarding one or more of: user symptoms, user food intake, user fluid intake, or user medication intake.

Clause 46. A method of treating nausea, the method comprising stimulating a region of the user's wrist about a P6 point for a predetermined time; and after the predetermined time, ceasing stimulating the region the user's wrist.

BRIEF DESCRIPTION OF THE DRAWINGS

Many aspects of the present disclosure can be better understood with reference to the following drawings. The components in the drawings are not necessarily to scale. Instead, emphasis is placed on illustrating clearly the principles of the present disclosure.

DETAILED DESCRIPTION

The present technology relates to devices for treating nausea and vomiting, and associated systems and methods of use. Some embodiments of the present technology, for example, are directed to devices for treating these conditions using nerve stimulation. Specific details of several embodiments of the technology are described below with reference to FIGS. 1A-3.

Figure 1A:
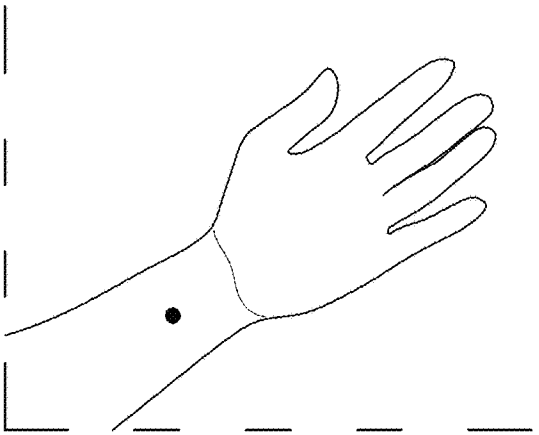
FIGS. 1A-1D illustrate identifying the P6 point on the wrist of a user.
Figure 1B:
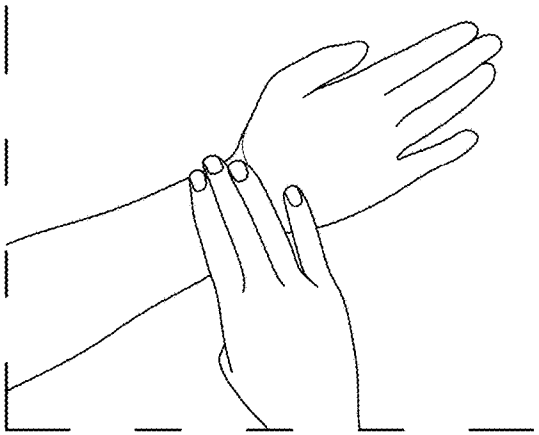
Figure 1C:
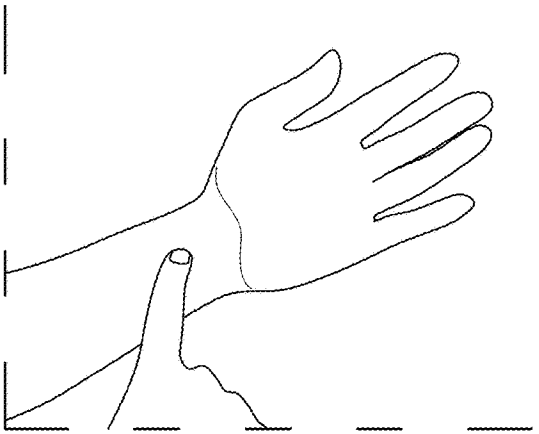
Figure 1D:
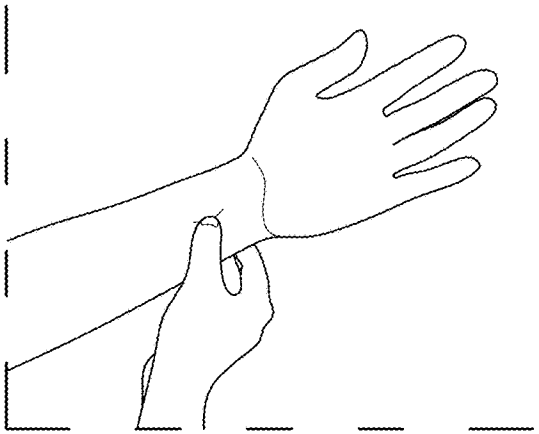

Stimulation of the median nerve at the P6 point (also referred to as Nei Guan or PC6) can be used to help relieve nausea, upset stomach, motion sickness, carpal tunnel syndrome, and headaches. P6 is located three finger breadths below the wrist on the inner forearm in between the tendons of the palmaris longus and flexor carpi radialis muscles, along the pericardium meridian (FIG. 1A). For treatment, downward pressure can be applied at the point between the two tendons, massaging and stimulating the area for a period of time, for example up to 3 minutes in some embodiments, or as little as 4-5 seconds in other embodiments. P6 is located approximately three finger-spaces below the wrist (FIG. 1B), and in the central depression between the tendons (FIGS. 1C and 1D). Although the "P6 point" is referred to throughout, in various embodiments the actual point being treated can be about, adjacent, or near the P6 point without being precisely co-located at or over the P6 point. In various embodiments, the treatment site can be any region of a user's wrist or forearm that allows stimulation of the median nerve or that otherwise produces therapeutic effects.

Stimulation of the P6 point has been shown to alleviate nausea and vomiting in pregnancy and also help prevent post-operative nausea and vomiting. Stimulation of the P6 point and Zu San Li (ST36) have been shown to have a combined, synergistic effect on gastrointestinal motility. P6 stimulation has also been shown to help alleviate intractable hiccups.

Embodiments of the present technology include a device for stimulating the median nerve (e.g., over the P6 point) to relieve symptoms of nausea, and vomiting or morning sickness and other causes of nausea and vomiting symptoms, which may include virtual reality, chemotherapy, motion sickness, post surgery. Stimulation of the P6 point can take a variety of forms in different embodiments, for example, stimulation via acupressure (e.g., vibrational pulsatile stimulation, an acoustic pressure wave, a pressure wave generated by a bladder/sack filled vessel, etc.), electrical stimulation, acupuncture (e.g., using a pad carrying one or more microneedles), thermal, or optical (e.g., infrared). In addition or as an alternative to P6 stimulation, the device may provide other output to a user, for example, instructions to perform some action such as taking medication, changing body position (e.g., lie down, stand up, etc.), changing movement (e.g., stop moving, start walking, etc.), change breathing, consume food or fluids, change location, turn on or off nearby lights, contact a clinician, listen to a specified sound, or take any other suitable action. In some embodiments, the device may provide other output to a user that does not involve directly stimulating the P6 point, for example an audible output (e.g., the device may output a particle sound to stimulate relief) or a visual output (e.g., a certain video or other visual output provided via the device or an associated device to stimulate relief).

In some embodiments, stimulation of the P6 point can be performed automatically in response to measurement of one or more physiological parameters that may be associated with increased likelihood of nausea and vomiting. Example physiological parameters include heart rate, blood pressure, respiratory rate, altitude (either absolute or relative (e.g., building height)), location, body position (e.g., standing, sitting, lying down), motion (e.g., sedentary vs. walking), body temperature, environmental temperature, electrolyte levels, etc. In some embodiments, the device can also receive additional user input, for example indicating food or fluid intake, medications, a user-specified onset of nausea, etc.

The device can take a variety of forms, for example a wearable device configured to stimulate the P6 point and/or to obtain one or more physiological measurements from the patient. In some embodiments, the device is a smartwatch or other wearable, internet-connected device that includes one or more sensors (e.g., heart rate, blood pressure, etc.) as well as a stimulator to provide pulsatile vibrational output. Such a smartwatch can be worn over the P6 point such that the vibrational output stimulates the median nerve at the P6 point, thereby relieving symptoms of nausea.

Example Devices and Systems for Nausea Treatment

Figure 2:
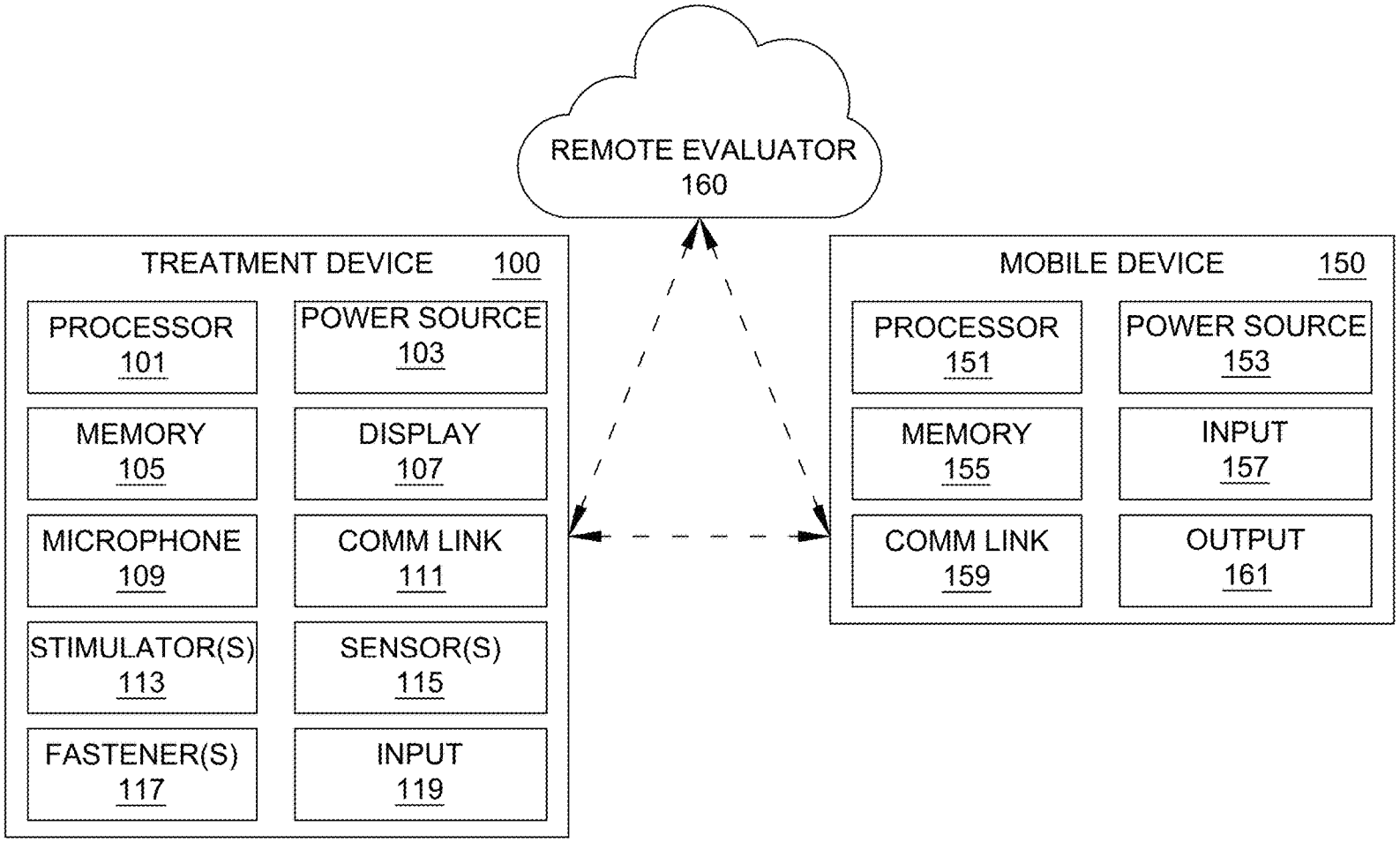
FIG. 2 is a schematic illustration of a treatment system in accordance with the present technology.

FIG. 2 illustrates an example system for treating nausea that includes a treatment device 100, a mobile device 150, and a remote evaluator 160. As illustrated, the treatment device 100, mobile device 150, and remote evaluator 160 can each communicate with one another over wired or wireless connections, as described in more detail below. In operation, the treatment device 100 can be used to treat an individual user for nausea or other conditions, for example by stimulating the P6 point of the user's arm based at least in part to physiological parameters obtained via one or more sensors. Optionally, the associated mobile device 150 may coordinate with the treatment device 100 to effect treatment, for example by providing instructions to the treatment device 100 to initiate or cease treatment, etc. In some embodiments, the remote evaluator 160 can collect data from the treatment device 100 and/or the mobile device 150, including data regarding treatment sessions, measured physiological parameters, and other relevant information. This data can be aggregated with other data collected from other users and/or other devices. The aggregated data may then be evaluated (e.g., using machine learning or other suitable techniques) to identify correlations or trends, improve treatment programs, provide individual user feedback, improve predictions of nausea onset, or otherwise modify operation of the treatment device 100. In some embodiments, using data from the remote evaluator 160, the treatment device 100 can detect approaching nausea and/or vomiting before onset and initiate treatment to provide relief before the symptoms manifest or reach full strength in the user.

In the illustrated embodiment, the treatment device 100 comprises a processor 101 and a power source 103 (e.g., a battery or an electrical connection component for receiving facility power). The processor 101 can be, for example, any suitable processor or central processing unit ("CPU") that controls operation of the device 100 in accordance with computer-readable instructions stored on the memory 105. The processor 101 may be any logic processing unit, such as one or more CPUs, digital signal processors (DSPs), application-specific integrated circuits (ASICs), etc. The processor 101 may be a single processing unit or multiple processing units in a device or distributed across multiple devices. The processor 101 is connected to the memory 105 and may be coupled to other hardware devices, for example, with the use of a bus (e.g., a PCI Express or Serial ATA bus). The memory 105 can include read-only memory (ROM) and random-access memory (RAM) or other storage devices, such as disk drives or SSDs, that store the executable applications, test software, databases and other software required to, for example, implement the various routines described herein, control device components, communicate and exchange data and information with remote computers and other devices, etc.

The processor 101 also includes drive circuitry configured to control operation of stimulator components 113 of the device 100. For example, the drive circuitry can be configured to deliver waveforms having predetermined and controllable parameters to one or more of the stimulator components 113. The stimulator components 113 can include hardware and software configured to stimulate an area of the user's body via mechanical stimulation (e.g., piezoelectric elements to emit vibrational energy, speakers to emit acoustic energy, etc.), electrical stimulation (e.g., electrodes), acupuncture (e.g., moving a pad of microneedles against the user's skin), thermal stimulation (e.g., heating elements), or optical stimulation (e.g., infrared). In one example, the stimulator components 113 include one or more piezoelectric elements configured to provide vibrational or haptic output. While such outputs may be conventionally used for notification to a user of a wearable device, the vibrational output may be utilized as disclosed herein to stimulate the P6 point of the user's forearm to treat nausea. In some embodiments, the stimulator components 113 can include a case or other accessory configured to amplify or otherwise cooperate with the vibrational output of the device 100 to provide higher intensity of stimulation. Embodiments of such an accessory may take a form of a protrusion made of material with specific physical and chemical properties and be configured with a particular geometry (e.g. pointy, rounded, etc.) and size to promote, enhance, or amplify vibrational output. Such an accessory may use mechanical or electrical mechanisms for directing and/or amplifying vibration from the stimulator components 113 towards the treatment site. In some embodiments, such an accessory can include a power source and provide haptic feedback or other suitable output. In at least some embodiments, the accessory may use moving parts and/or utilize mechanical resonance to amplify vibrations.

In some embodiments, the treatment device 100 also includes one or more sensors 115. Such sensor(s) 115 can be configured to obtain one or more physiological parameters of the user, such as heart rate, blood pressure, respiratory rate, altitude, geolocation, bodily position, bodily movement, body temperature, environmental temperature, electrolyte levels, etc. In various embodiments, any suitable sensor can be in communication with or integrated into the device 100. For example, in some embodiments a remote sensor can transmit physiological data to the treatment device 100 for determination of one or more physiological parameters. The processor 101 can provide information and instructions to device users via the display 107, microphone (s) 109 (e.g., built-in microphones, removable headphones, earphones, or cochlear implant, etc.), or other suitable output device (e.g., tactile output, etc.). The processor 101 can also receive user inputs via input 119, which can take the form of a touch screen, dials, knobs, switches, buttons, keys, microphones, cameras, or other suitable input elements. In some embodiments, the user-provided inputs can include an indication of food intake, an indication of fluid intake, an indication medication intake, an indication of nausea, or an indication of vomiting.

In some embodiments the treatment device 100 may be controlled at least in part based on instructions or other input received from the input 119. For example, the treatment device 100 may include a mobile application (or "app") that allows a user to modify therapy delivered via the stimulator components 113 including, for example, duration, amplitude, waveform, frequency, duty cycle, or any other parameter.

The treatment device 100 may also include a communication link 111, which can include a wireless connection (e.g., including a Wi-Fi access point, Bluetooth transceiver, near-field communication (NFC) device, and/or wireless modem or cellular radio utilizing GSM, CDMA, 3G and/or 4G technologies) or a wired connection (e.g., an Ethernet port, cable modem, FireWire cable, Lightning connector, USB port, etc.) for data communication with all manner of remote processing devices via a network connection and/or directly via, e.g., a wireless peer-to-peer connection. For example, the communication link 111 can facilitate wireless communication with handheld devices, such as mobile device 150 (e.g., a smartphone, blood glucose monitor, etc.) either in the proximity of the device 100 or remote therefrom.

In some embodiments, the treatment device 100 may also communicate with a mobile device 150. The mobile device 150 can include one or more features, applications and/or other elements commonly found in smartphones and other known mobile devices. For example, the mobile device 150 can include a processor 151 (e.g., a CPU and/or a GPU) for executing computer readable instructions stored on memory 155. In addition, the mobile device 123 can include an internal power source 153 such as a battery, and well-known input components 157 and output components 161, including, for example, a touch screen, a keypad, speakers, a camera, etc. In addition to the foregoing features, the mobile device 150 can include a communication link 159 (e.g., a wireless transceiver that may include one or more antennas for wirelessly communicating with, for example, other mobile devices, websites, and the treatment device 100). Such communication can be performed via, e.g., a network (which can include the Internet, public and private intranet, a local or extended Wi-Fi network, cell towers, the plain old telephone system (POTS), etc.), direct wireless communication, etc. In various embodiments, the mobile device 150 can be a smartphone, portable physiological sensor, fitness monitor, smartwatch, sensor-embedded clothing, or any other suitable device.

In some embodiments the treatment device 100 may be controlled at least in part based on instructions or other input received from the mobile device 150. For example, the mobile device 150 may include a mobile application (or "app") that allows a user to modify therapy delivered via the stimulator components 113 including, for example, duration, amplitude, waveform, frequency, duty cycle, or any other parameter. In some embodiments, the mobile device 150 may be configured to monitor other physiological parameters, for example heart rate, blood pressure, etc. Based on measurements of physiological parameters obtained via the mobile device 150, the treatment device 100 may vary application of the stimulation components 113. In other embodiments, the mobile device 150 may be omitted altogether, and the treatment device 100 can operate without relying on input from the mobile device 150.

The treatment device 100 optionally also includes fastener components 117. For example, the treatment device 100 can be enclosed in a housing and coupled to a strap to be worn around a user's wrist such that the housing is disposed over the P6 point. In various embodiments, the fastener components 117 can include a strap, adhesive, garment (e.g., a glove), or any other suitable mechanism for positioning the treatment device 100 over the P6 point or other treatment site. In some embodiments, the treatment device 100 may be temporarily moved into a treatment position by the user for improved stimulation of the P6 point. For example, a smartwatch-like device 100 may be turned on its edge and pressed against the P6 point, which can provide more vibrational energy to the underlying median nerve. In some embodiments, a mobile device (e.g., a smartphone) may be placed on edge and pressed against the P6 point, which can provide more vibrational energy to the underlying median nerve. Alternatively or additionally, a specially designed delivery device shaped and configured to delivery vibrational energy or other output towards the P6 point when positioned against a user's wrist may be utilized.

Figure 3:
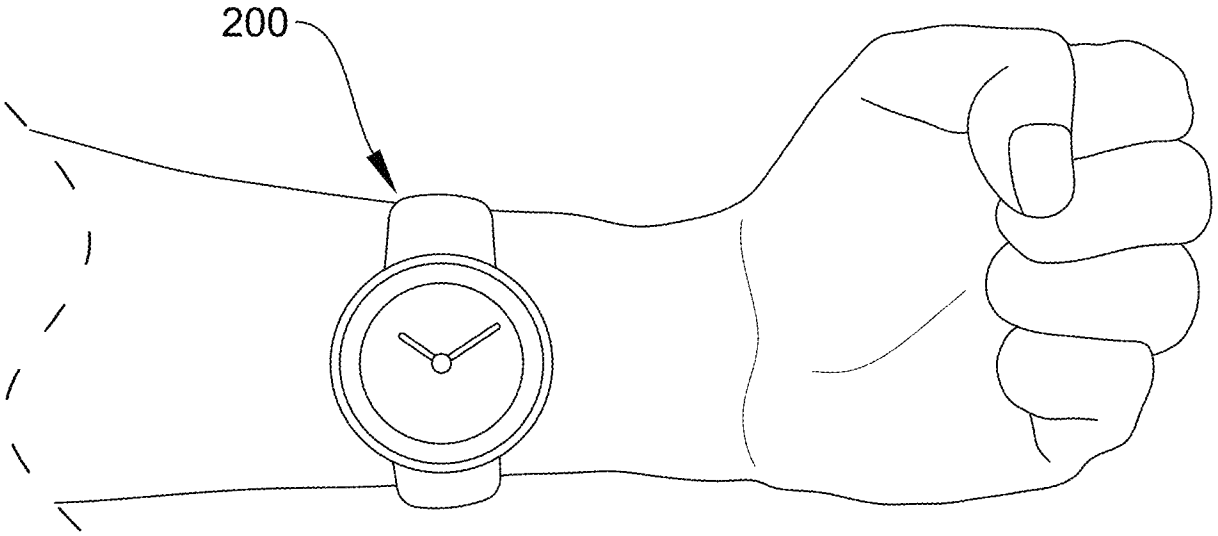
FIG. 3 illustrates an example treatment device in accordance with the present technology.

FIG. 3 illustrates an example of a treatment device 200 in position over the P6 point of a user's forearm. In this example, the treatment device 200 takes the form of a smartwatch, which can include sensor components and stimulator components as described above with respect to FIG. 1. The device 200 is fastened to the user's wrist at a position slightly lower along the user's wrist than a standard watch placement, and is also positioned with the watch face facing away from the anterior side of the user's wrist. In this position, stimulation from the device 200 (e.g. vibrational output emitted via actuators within the device 200) will be directed to the median nerve at the P6 point of the user's forearm, thereby effecting treatment for nausea, vomiting, or other conditions.

Example Methods of Treating Nausea

As noted above, a wearable treatment device 100 can be configured to apply stimulation (mechanical, electrical, acupuncture, etc.) to the P6 point of a user's wrist to treat nausea. In some embodiments, a user may directly control stimulation, for example via a simple on-off switch or via initiation of a predefined treatment regime (e.g., a 10 Hz vibrational stimulation for 10 minutes). In some embodiments, stimulation can be delivered based at least in part on physiological parameters which can be obtained either via sensors 115 or via direct user input. For example, sensors can be configured to detect parameters such as heart rate, blood pressure, respiratory rate, altitude, location, body position (e.g., standing, sitting, lying down), motion (e.g., sedentary vs. walking, riding in a plane, roller skating, horseback riding, other modes of transport), body temperature, environmental temperature, electrolyte levels, etc. Examples of physiological parameters derived from user input include an indication of food intake, an indication of fluid intake, an indication medication intake, an indication of nausea, or an indication of vomiting. In some embodiments, these indications can be provided from the user via input 119 of the treatment device 100 and/or the input 157 of the mobile device 150. In some embodiments, these inputs can be provided in response to specific queries with multiple-choice selections. For example, the display 107 of the device 100 may display "Are you feeling nauseous?" with selectable "Yes" and "No" buttons. Using this or other similar techniques, the treatment device 100 can collect user-provided physiological parameters. In some embodiments, the user can be prompted with questions corresponding to the Rhodes Index of Nausea and Vomiting, a validated measure of nausea and vomiting used in clinical settings.

One or more of these physiological parameters can be evaluated to provide an indication of nausea or a risk of approaching nausea. In some embodiments, a plurality of these parameters can be combined and weighted into an index intended to correspond to nausea symptoms. In some embodiments, the remote evaluator 160 can collect physiological parameters from a wide number of users. This dataset may be used to correlate one or more of the physiological parameters with the onset of nausea. These correlations may be general (for example, if all users have an increase in blood pressure coincident with the onset of nausea) or user-specific (for example, if a particular user is more likely to experience nausea when driving in a car than otherwise). In various examples, nausea may be indicated or predicted based on detected increase in heart rate, changes in chemical and or electrolyte (e.g., potassium) balance, changes in glucose levels, changes in actigraphy measures, changes in respiratory rate (e.g., shallow or deep breathing, holding breath, etc.), or other suitable physiological parameters that are identified as being associated with nausea or other conditions.

These correlations can be determined using any suitable statistical techniques, including regression, machine learning, deep learning, neural networks (deep neural networks, convolutional neural networks, recurrent neural networks, etc.), or other approach. With these correlations, for any particular user, the treatment device 100 may provide an indication of nausea (e.g., an indication that nausea has onset or that it is expected to onset shortly). This indication can be provided to the user, for example, via the display 107 of the treatment device 100 or the output 161 of the mobile device 150.

In response to the indication of nausea, the treatment device 100 can stimulate the P6 point of the user's forearm, as noted previously. This stimulation can be mechanical (e.g., using vibrational energy), electrical (e.g., using one or more electrodes), acupuncture-based (e.g., using microneedles), or can take any other suitable form. The mode of stimulation (e.g., intensity, frequency, duration, or other parameters) may be varied based at least in part on the physiological parameters. Alternatively or additionally, the device 100 can provide output to the user. For example, output via the display 107 of the device 100 or the output 161 of the mobile device 150 can include instructions to perform some action such as taking medication, changing body position (e.g., lie down, stand up, etc.), changing movement (e.g., stop moving, start walking, etc.), change breathing (e.g., mindful breathing instructions), consume food or fluids, change location, turn on or off nearby lights, contact a clinician, or take any other suitable action. In some embodiments, the treatment device 100 may provide other output to a user that does not involve directly stimulating the P6 point, for example an audible output (e.g., the treatment device 100 and/or the mobile device 150 may emit a particular sound to stimulate relief) or a visual output (e.g., a certain video or other visual output provided via the display 107 of the treatment device 100 or the output 161 of the mobile device 160.

While the treatment device 100 effects treatment (e.g., via stimulation of the P6 point or other treatment output), the sensors 115 may continue to monitor physiological parameters, and may continue to do so after treatment has ceased. This data may likewise be sent to the remote evaluator 160 for assessment and aggregation with other user data. The data set may provide an indication that correlates certain physiological parameters with relief from nausea. For example, if a user is found to be likely nauseous due to physiological parameters, when those parameters shift back to a historical baseline for that user, this can indicate that the nausea has passed. In some embodiments, specific user input can corroborate or disconfirm these correlations (e.g., a user may be asked "Are you still nauseous?" with selectable "Yes" and "No" buttons provided via the display 107 of the treatment device 100.

As noted previously, in some embodiments, data from an individual user (e.g., physiological parameters obtained via a treatment device 100 or otherwise collected from a user) can be analyzed and evaluated in the context of the aggregated data from a large number of individual users. In some embodiments, comparing or otherwise evaluating an individual user's data with aggregated data from other users can be used to create a unique treatment for that particular individual user. For example, various algorithms for the stimulation of the P6 point (e.g., varying in rate, intensity, and/or duration) may elicit different responses for different individuals experiencing nausea. By collecting large data sets from a population of users, embodiments of the present technology can use artificial intelligence, machine learning, or other suitable computational techniques to generate customized therapies to address nausea for particular users. As one example, a user may optionally commence treatment with a first algorithm (e.g., rate=10 Hz, intensity=50%, duration=300 sec). The user may then provide feedback to remote evaluator 160 regarding the efficacy of the treatment. The user may also provide pertinent information regarding their individual situation (e.g., location, stress level, activity etc.). Using machine learning, artificial intelligence, and/or any other suitable computational techniques, a customized treatment algorithm may be developed for that particular individual. In some embodiments, the large data sets collected from a population of users (including physiological and environmental conditions) may be used to recognize each individual's onset of symptoms and apply a customized and/or optimized therapeutic treatment algorithm for each individual user. Accordingly, the large data set of physiological parameters and treatment outcomes collected from a population of users can allow for more intelligent, customized therapeutic interventions to be automatically deployed to individual users.

In some embodiments, the treatment device 100 may use a user's location (e.g., as determined via sensors 115) to identify other users in the user's vicinity and recommend connecting virtually (e.g., via text messages, video, or voice) to organize and meet for face-to-face interactions. Such in-person meetings may facilitate formation of support groups curated by the system's behavioral optimizations recommendations. In some embodiments, location is also be utilized to recommend places of relaxation or providers of expertise prior to onset on nausea and vomiting or in real-time at the onset of severe nausea and vomiting. Patterns of location information may be used to identify nausea behaviors that may be flagged for a user to avoid. For example, a user may be prompted to pull over after driving for a predetermined amount of time if, based on historical data, the user is likely to experience nausea after driving for at least the predetermined amount of time.

Additional Applications

Although many of the embodiments are described above with respect to systems, devices, and methods for treatment of nausea or morning sickness, the technology is applicable to other applications and/or other approaches, such as treatment of hyperemesis graviderum, depression, sleep problems, or other conditions often associated with pregnancy. In various embodiments, the treatment device 100 can be adapted to stimulate nerves at different sites other than the P6 point, for example other points along the user's arms or legs, along the user's spine, or any other suitable location for the treatment device 100 to effectively stimulate an underlying nerve. Although the treatment device 100 is illustrated and described as including stimulator components and sensor components, in some embodiments these may be separated into different devices, such that a stimulator device is worn over the treatment site (e.g., over the P6 point of the user's forearm), while the sensors are disposed elsewhere about the body, with the sensor information or an indication to initiate treatment being communicated to the stimulators via a wired or wireless connection. Other embodiments in addition to those described herein are within the scope of the technology. Additionally, several other embodiments of the technology can have different configurations, components, or procedures than those described herein. A person of ordinary skill in the art, therefore, will accordingly understand that the technology can have other embodiments with additional elements, or the technology can have other embodiments without several of the features shown and described above with reference to FIGS. 1A-3.

Conclusion

The above detailed descriptions of embodiments of the technology are not intended to be exhaustive or to limit the technology to the precise form disclosed above. Where the context permits, singular or plural terms may also include the plural or singular term, respectively. Although specific embodiments of, and examples for, the technology are described above for illustrative purposes, various equivalent modifications are possible within the scope of the technology, as those skilled in the relevant art will recognize. For example, while steps are presented in a given order, alternative embodiments may perform steps in a different order. The various embodiments described herein may also be combined to provide further embodiments.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications may be made without deviating from the technology. Further, while advantages associated with certain embodiments of the technology have been described in the context of those embodiments, other embodiments may also exhibit such advantages, and not all embodiments need necessarily exhibit such advantages to fall within the scope of the technology. Accordingly, the disclosure and associated technology can encompass other embodiments not expressly shown or described herein.

The invention claimed is:

1. A method of treating nausea, the method comprising:

monitoring one or more physiological parameters of a user via a wearable device;

evaluating the one or more physiological parameters using an aggregated history of physiological data and nausea events from a population of users and a user-specific history of physiological data and nausea events;

based on the evaluation, obtaining an indication of nausea onset or of approaching nausea;

based on the indication, obtaining a customized treatment for the user, wherein the customized treatment characterizes at least a frequency, intensity, and duration of a mechanical actuator;

based at least in part of the indication, stimulating a region of the user's wrist about a P6 point via the mechanical actuator in accordance with the customized treatment;

obtaining an indication of user relief from nausea symptoms; and after obtaining the indication of user relief, ceasing stimulating the region of the user's wrist.

2. The method of claim 1, further comprising, based on the one or more physiological parameters, providing an indication, via the wearable device, to the user to modify the user's behavior.

3. The method of claim 2, wherein modification of the user's behavior comprises one or more of: changing body position, changing movement, changing breathing, changing food or fluid intake, changing location, turning on or turning off lights, contacting a specified individual, listening to a specified sound, or viewing a specified visual output.

4. The method of claim 1, further comprising transmitting, via the wearable device, information regarding the treatment to one or more remote computing devices.

5. The method of claim 1, wherein monitoring one or more physiological parameters comprises sensing one or more of: the user's heart rate, blood pressure, respiratory rate, bodily position, bodily movement, body temperature, altitude, chemical levels, or electrolyte levels.

6. The method of claim 1, wherein monitoring one or more physiological parameters comprises receiving input from the user regarding one or more of: user symptoms, user food intake, user fluid intake, or user medication intake.

7. A method of treating nausea or a gastric motility disorder, the method comprising:

monitoring one or more physiological parameters of a user via a wearable device;

evaluating the one or more physiological parameters using an aggregated history of physiological data and symptom events from a population of users and a user-specific physiological data and symptom events;

based on the evaluation, obtaining an indication of symptom onset or of approaching symptoms;

based on the indication, obtaining a customized treatment for the user, wherein the customized treatment characterizes at least a frequency, intensity, and duration of a mechanical actuator;

based at least in part on the one or more physiological parameters, stimulating the median nerve via the mechanical actuator in accordance with the customized treatment;

obtaining an indication of user relief from symptoms; and after obtaining the indication of user relief, ceasing stimulating the median nerve.

8. The method of claim 7, wherein monitoring one or more physiological parameters comprises sensing, via the wearable device, one or more of: the user's heart rate, blood pressure, respiratory rate, bodily position, bodily movement, body temperature, geolocation, altitude, chemical levels, or electrolyte levels.

9. The method of claim 7, wherein monitoring one or more physiological parameters comprises receiving input from the user regarding one or more of: user symptoms, user food intake, user fluid intake, or user medication intake.

10. A method of treating nausea, the method comprising:

receiving, at one or more computing devices, one or more physiological parameters associated with a user of a wearable device;

evaluating the one or more physiological parameters using an aggregated history of physiological data and nausea events from a population of users and a user-specific physiological data and nausea events;

based on the evaluation, obtaining an indication of nausea onset or of approaching nausea;

based on the indication, obtaining a customized treatment for the user, wherein the customized treatment characterizes at least a frequency, intensity, and duration of a mechanical actuator; and in response to the indication, providing instructions to the wearable device to initiate stimulation of a nerve of the user via the mechanical actuator in accordance with the customized treatment.

11. The method of claim 10, wherein the wearable device is configured to be worn over a user's wrist.

12. The method of any claim 10, wherein stimulating the nerve comprises delivering energy to the nerve via mechanically stimulating a P6 region of a wrist of the user via the wearable device.

13. The method of claim 10, further comprising, based on the one or more physiological parameters, providing an indication, via the wearable device, to the user to modify the user's behavior.

14. The method of claim 1, wherein the obtaining of the indication of user relief from nausea symptoms comprises:

outputting a user-interface element that allows a user to indicate whether the user is still experiencing nausea; and receiving a user input via the user-interface element.

15. The method of claim 14, further comprising:

responsive to receiving the user input via the user-interface element, storing a record of the user input, an associated treatment, and the one or more physiological parameters in an aggregated collection of such user records; and analyzing the aggregated collection of user records to develop additional treatments.

16. The method of claim 14, wherein the obtaining of the indication of user relief from nausea symptoms comprises:

continuing to monitor the one or more physiological parameters of a user via the wearable device;

evaluating the one or more physiological parameters; and based on the evaluation, obtaining an indication of user relief from nausea symptoms.

17. The method of claim 1, wherein the one or more physiological parameters comprises a user's geolocation data.

18. The method of claim 1, further comprising, based on the indication, providing a prompt, via the wearable device, to the user to modify the user's behavior, wherein modification of the user's behavior comprises one or more of: changing body position, changing movement, or changing breathing.

* * * * *